US006672991B2

(12) United States Patent
O'Malley

(10) Patent No.: US 6,672,991 B2
(45) Date of Patent: Jan. 6, 2004

(54) GUIDED INSTRUCTIONAL CARDIOVASCULAR EXERCISE WITH ACCOMPANIMENT

(76) Inventor: Sean M. O'Malley, 5000 Whitestone La., #634, Plano, TX (US) 75024

( * ) Notice: Subject to any disclaimer, the term of this patent is extended or adjusted under 35 U.S.C. 154(b) by 275 days.

(21) Appl. No.: 09/819,435

(22) Filed: Mar. 28, 2001

(65) Prior Publication Data

US 2002/0142887 A1 Oct. 3, 2002

(51) Int. Cl.[7] ..... A63B 21/00
(52) U.S. Cl. ..... 482/8; 482/1; 482/900
(58) Field of Search ..... 482/1–9, 51, 57, 482/54, 900–902; 434/247

(56) References Cited

U.S. PATENT DOCUMENTS 6,193,631 B1 * 2/2001 Hickman ..... 482/8
6,287,239 B1 * 9/2001 Hernandez ..... 482/1
6,497,638 B1 * 12/2002 Shea ..... 482/8

* cited by examiner

*Primary Examiner*—Glenn E. Richman
(74) *Attorney, Agent, or Firm*—Kaufman & Canoles

(57) ABSTRACT

A cardiovascular exercise program that includes selectable virtual and real time directed and/or guided exercises particularly adapted for stationary exercise equipment. The program may be performed by individuals in virtual or actual groups. The program allows individual participants to ascertain their ongoing physical conditions such that the participants may customize the exercise program criteria to reflect recognition of such ongoing physical conditions. The program may be performed in a delayed or real-time mode, and includes a particular form of guidance that enables an individual to achieve objectives of self awareness and exercising at appropriate levels through a unique combination of verbal queues, guidance, motivation, entertainment, community, participation, and achievement monitoring. Thus, an individual can increase his or her level of fitness by controlling their perceived level of exertion and the performance of their heart during exercise through guidance and monitoring.

38 Claims, 2 Drawing Sheets

GUIDED INSTRUCTIONAL CARDIOVASCULAR EXERCISE WITH ACCOMPANIMENT

BACKGROUND OF THE INVENTION

1. Field of Invention

This invention relates to cardiovascular exercise and more particularly to a combination of guidance, motivation, entertainment, participation and achievement monitoring.

2. Description of Related Art

Various proposals have heretofore been made for facilitating physical exercise, illustrative of which are the proposals of U.S. Pat. No. 4,408,613 granted to Richard D. Relyea on Oct. 11, 1983; U.S. Pat. No. 4,919,418 granted to Jan W. Miller on Apr. 24, 1990; U.S. Pat. No. 4.934,694 granted to James L. McIntosh on Jun. 19, 1990; U.S. Pat. No. 4,982,951 granted to Elyena Foster et al on Jan. 8, 1991; U.S. Pat. No. 5,474,090 granted to S. J. Begun et al. on Dec. 12, 1995; U.S. Pat. No. 5,785,632 granted to Andrew D. Greenberg et al. on Jul. 28, 1998; U.S. Pat. No. 5,857,939 granted to Arthur H. Kaufinan on Jan. 12, 1999; U.S. Pat. No. 5,888,172 granted to Bryan DeWitt Andrus et al. on Mar. 30, 1999; U.S. Pat. No. 5,921,891 granted to James Neville Browne on Jul. 13, 1999; U.S. Pat. No. 5,980,429 granted to Lewis M. Nashner on Nov. 9, 1999; U.S. Pat. No. 6,027,428 granted to Mark Thomas et al. on Feb. 22, 2000; U.S. Pat. No. 6,053,844 granted to William Clem on Apr. 25, 2000; U.S. Pat. No. 6,059,692 granted to Paul L. Hickman on May 9, 2000; U.S. Pat. No. 6,066,075 granted to Craig K. Poulton on May 23, 2000; and U.S. Pat. No. 6,132,337 granted to Yaakov Krupka et al. on Oct. 17, 2000.

There have also been proposals disclosed in publications, illustrative of which is the article "Indoor Touring" which appeared at page 17 of the December 1985 issue of a magazine (identity unknown) Class 482–902, referenced and copied in the Disclosure Statement, which is to be a part of the record of this application.

According to these proposals, a number of selected exercise regimens are described. Thus, for example, U.S. Pat. No. 4,408,613 discloses a form of interactive exercise; U.S. Pat. No. 4,919,418 discloses a form of monitored and controlled exercise including audio-visual display with animated graphics and encouraging spoken remarks; U.S. Pat. No. 4,934,694 discloses a computer-controlled exercise system; U.S. Pat. No. 4,982,951 discloses an exercise walker system that encourages movement through audible indicia; U.S. Pat. No. 5,474,090 discloses physiological monitoring and exercise for physical fitness as well as cardiac and orthopedic rehabilitation; U.S. Pat. No. 5,785,632 discloses apparatus for providing feedback to a user of a weight stack machine; U.S. Pat. No. 5,857,939 discloses electronic exercise monitoring and motivational speech; U.S. Pat. No. 5,888,172 discloses a physical exercise video system including interactive communication and control; U.S. Pat. No. 5,921,891 discloses a computer controlled and monitored exercise system; U.S. Pat. No. 5,980,429 discloses a system and method for monitoring and evaluating training programs; U.S. Pat. No. 6,027,428 discloses a system for personalized real-time audible instructions for physical fitness training; U.S. Pat. No. 6,053,844 discloses an interactive programmable fitness system including remote control and monitoring. U.S. Pat. No. 6,059,692 discloses an exercise system having local and remotely located computers for control, monitoring and conditioning of an exercise program; U.S. Pat. No. 6,066,075 discloses programmable coordination of tracking and sensory interface devices including actuators for providing aural, optical, tactile and electromuscular stimulation to a user; and U.S. Pat. No. 6,132,337 discloses an interactive exercise monitoring system. While the foregoing and other existing proposals provide a variety of aggregative individual features of controlled interactive exercise and physical conditioning, there yet remains a need for further improvement in combining features including guidance, motivation, entertainment, participation, encouragement and achievement monitoring for physical therapy and conditioning.

The foregoing are illustrative of known exercise systems, which generally partake of two characteristics. The first is the group physically-associated, or grouped, program in which participants assemble in a common location and are directed in their exercise program either through audio-visual instructions. In such instance, all of the participants are conducted through the same program, which thus is not tailored to each individual participant. The second system employs a trainer who directs a participant through an exercise routine that is tailored to the specific physical condition and conditioning objectives of the participant involved. Each of these systems has its advantages and disadvantages.

BRIEF SUMMARY OF THE INVENTION

The present invention provides advantages of both of the foregoing systems. This occurs through enhancing, motivating and encouraging individual participant involvement in setting parameters for his/her exercise sessions. It overcomes certain other problems of the prior art and, as more particularly set forth below, affords a number of important advantages in guided instructional cardiovascular exercise therapy and conditioning.

Briefly stated, in addition to the foregoing, the present invention combines into one integrated system the features of participant selection, virtual and real time directed and/or guided exercise particularly adapted for stationary exercise equipment. Such equipment includes spinning bikes, upright bikes, recumbent bikes, elliptical machines, stair stepper/climbers and treadmill/trekers, cross-country simulators and rowing machines. This may be accomplished individually or in virtual or actual groups. Also included is audio-visual accompaniment selectable from music, nature sounds and exercise-related sounds for enhancing the exercise experience from the perspective of guidance, motivation, entertainment and achievement monitoring.

To facilitate individualization to particular needs of individuals, provision is made for ascertaining the ongoing physical conditions of participants and for participants to customize exercise criteria to reflect recognition of such ongoing physical conditions. These criteria include, for example, the length of the exercise periods, exertion levels during the exercise periods, and establishment of heart rate (pulse) zones during the exercise periods. To include a full range of features, provision is made for delayed or real-time modes. Delayed participants are those who participate in a delayed manner after guidance has occurred, while real-time participants are those who participate while guidance is being provided.

Further extending versatility and range of operation, provision is made for distribution of guidance over the Internet and other modes of communication to devices such as MP3 players, computers, Personal Digital Assistants (PDAs), and the like. Downloads may be may be made using wireless cable, satellite, microwave, and the like. Thus, the systems and methods may be employed without geographic limitation, and interactive participation is encouraged.

Also included is a particular form of guidance, which enables an individual to achieve objectives of self awareness and exercising at appropriate levels through a unique combination of verbal queues, motivation, entertainment, participation, and achievement monitoring. Thus, an individual can increase his or her level of fitness by controlling their perceived level of exertion and performance of their heart during exercise through guidance and monitoring. Provision also is made for similar control and conditioning for groups of persons as well as individuals. Control, for stationary exercise devices, includes, for example, speed, difficulty, and incline, while levels of exertion are contemplated as an individual's ability to exercise at certain percentages of their maximum effort.

In addition to the foregoing, provision is made for transferring responsibility of controlling the exercise equipment and determining the level of exertion from an instructor to the person or group participating in the exercise. Thus, there is incorporated into the systems and methods active participant involvement including ideas and suggestions in the form of guidance, motivation, entertainment, participation and monitoring of achievement.

It is one general object of the invention to improve cardiovascular exercise.

It is another object of the invention to facilitate versatility in exercise systems.

It is still another object of the invention to facilitate virtual and real-time exercise.

It is yet another object of the invention to extend the reach of exercise systems geographically.

It is another object of the invention to include facilitating interest, motivation and exercise.

Accordingly, in accordance with one feature of the invention, exercise programs embody varying levels of exertion selected by the user, thus contributing to versatility and personal identification.

In accordance with another feature of the invention, users are encouraged to establish exertion levels correlated with their individual pulse rates, thus additionally contributing to personal identification and customization.

In accordance with still another feature of the invention, visual and/or audible indicia are presented to participants, thus creating a sense of virtual community and further enhancing motivation.

In accordance with yet another feature of the invention, a variety of virtual experiences are presented to participants, thus enhancing interest and commitment.

In accordance with one additional feature of the invention, provision is made for variety in exercise regimens, thus additionally contributing to interest, commitment and progress.

In accordance with yet another feature of the invention, in one embodiment, exercise sessions include warm-up, steady-state, challenge and cool-down phases, thus enhancing exercise effectiveness.

These, and other objects and features of the invention, will be apparent from the following detailed description, by way of a preferred example, with reference to the drawings.

DEFINITIONS

Figure 1:
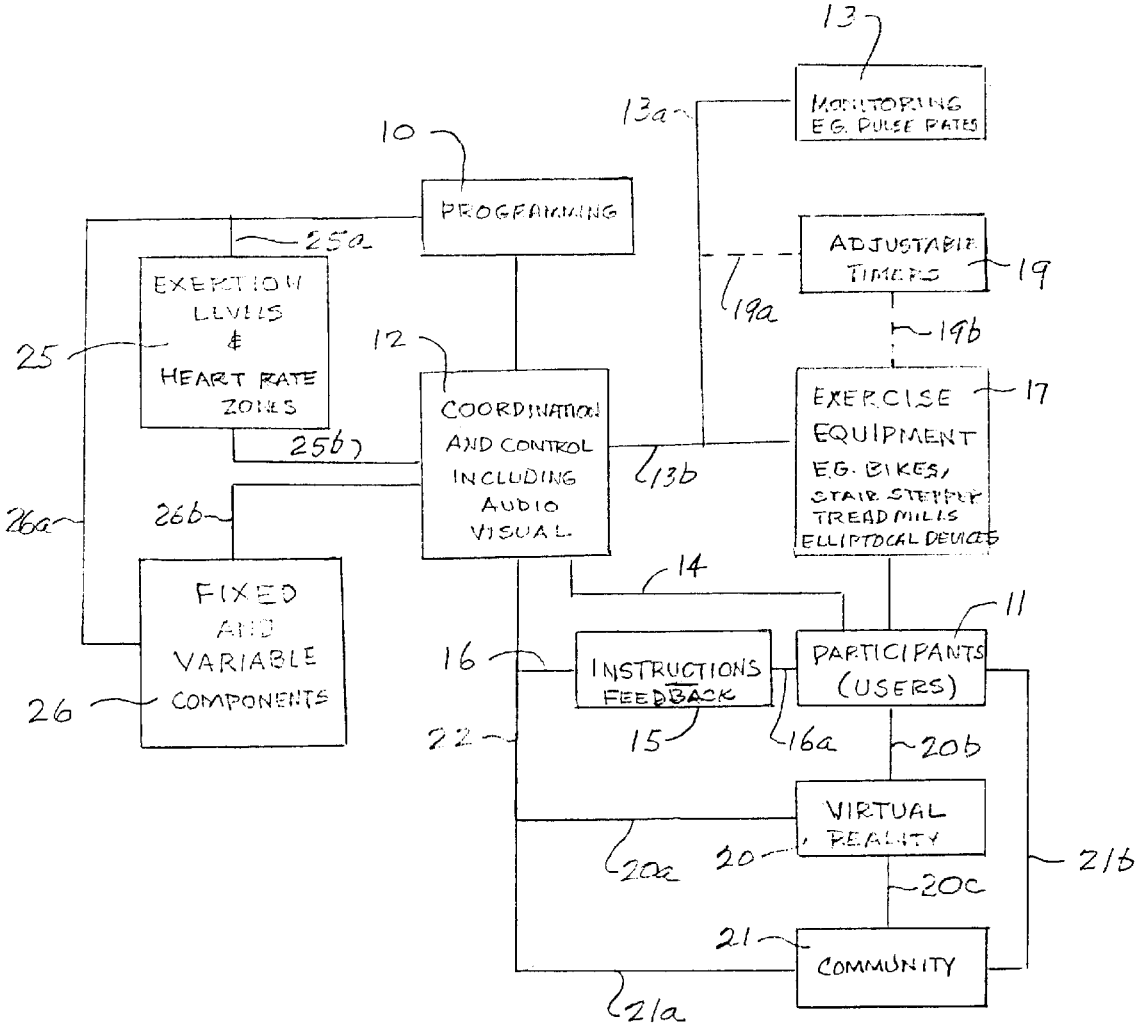
FIG. 1 is a schematic view illustrating the principal components of the system.

Before proceeding with a detailed description of the preferred embodiments, definitions of selected terms as employed in this specification and claims are set forth as follows:

Accompaniment: A combination of indicia selected from a group having music, nature sounds, and exercise-related sounds that enhance the exercise experience from the perspective of guidance, motivation, entertainment and achievement monitoring.

Participant Guidance: A combination of verbal queues, motivation, entertainment, participation and achievement monitoring.

Real Time Participant: A person who participates while guidance is being given.

Virtual Participant: A person who participates in a delayed manner after guidance has occurred.

Maximum Heart Rate: A heart beat (pulse) rate of 220 minus the age of the participant.

Maximum Effort: The exercise effort for each participant that would result in a maximum heart (pulse) rate for that participant.

Heart Rate Zone 1: A heart beat (pulse) rate of 60 to 70 percent of a participant's Maximum Heart Rate.

Heart Rate Zone 2: A heart beat (pulse) rate of 70 to 80 percent of a participant's Maximum Heart Rate.

Heart Rate Zone 3: A heart beat (pulse) rate of 80 to 90 percent of a participant's Maximum Heart Rate.

Levels of Exertion: Exercise at selectable percentages of maximum effort.

Exertion Level 1: Corresponds to Heart Rate Zone 1. Exertion at a level of 55–65 percent of Maximum Effort.

Exertion Level 2: Corresponds to Heart Rate Zone 2. Exertion at a level of 65–75 percent of Maximum Effort.

Exertion Level 3: Corresponds to Heart Rate Zone 3. For exercisers of intermediate fitness, exertion at a level of 75–85 percent of Maximum Effort For exercisers of advanced fitness, Exertion Level 3 is at a level of 70–80 percent of Maximum Effort; and for beginning exercisers, Exertion Level 3 is at a level of 80–90 percent of Maximum Effort.

Exertion Level 4: Exertion at a level of 85 percent or more of Maximum Effort.

In the following description, it will be helpful to understand that:

Exertion Level 1 will normally be used for the warm up, cool down and rest periods of a workout, thus representing minimal effort and ease of performance;

Exertion Level 2 occurs during a workout to provide an exercise level that a participant should feel he/she could exercise at for an entire workout with controlled breathing and little fatigue;

Exertion Level 3 occurs during a workout to provide one or more challenges and represents longer interval periods of either faster speed or increased resistance, or both. When performing at Exertion Level 3, a participant should be able to maintain exercise at that level for at least three to five minutes before fatiguing and losing breath; and Exertion Level 4 occurs during a workout to provide shorter interval periods of work of either increased speed or resistance and is also used for challenge phases of a workout. When a participant works at Exertion Level 4, it will be at or near their absolute effort for no longer than 1 minute.

DESCRIPTION OF AN EXEMPLARY EMBODIMENT

Now turning to the drawing, FIG. 1 is seen to be a schematic view illustrating the principal components of the system. There, it will be seen are an element 10 titled "programming". By programming is meant the algorithm underlying the sequence of actions that occur in conducting an exercise program in accordance with the invention. This sequence of actions may be communicated to participants 11 by any audio visual means well known in the arts such as through an internet access, a compact disk player, an MP3 player and the like. It also can be communicated directly from a live instructor who may be conducting a class in exercises.

As also seen in FIG. 1, there is provided coordination and control 12, which carries out the algorithm of Program 10. Such coordination and control may be conducted manually or with electronic assistance, e.g., an electronic computer. In either event, provision is made for communicating with Participant 11 directly as illustrated by path 14 or through instructions-feedback 15 via links 16/16*a*. As will be evident to those skilled in the art, instructions and/or feedback can be implemented in a variety of ways such as by oral or written communications, selection of options presented on a video screen or by other visual or audible indicia.

Other system elements include pulse rate monitoring as illustrated by block 13. Such monitoring may be limited to that conducted by a user 11 but may also be interconnected with coordination & Control 12 as illustrate by links 13*a* and 13*b*.

One or more adjustable timers such as timer 19 may advantageously be included, although timing may be provided by coordination and control 12 if desired. Accordingly, discretionary timer 19 is shown as being connected by dashed lines 19*a* and 19*b*, which identify optional links to exercise equipment 17 and coordination and control 12.

Although the invention may be practiced while using any of a wide variety of exercise equipment, it has been found to be particularly adapted to upright, recumbent and spin bikes, elliptical cross training machines, stepper and mill stair climbers, and treadmills, preferably (although not necessarily) with adjustable inclines. This is illustrated by block 17 Exercise Equipment.

It will be recalled that features of the invention include the creation of virtual reality and community of identification for participants. Such will be described in greater detail below. However, they are illustrated in FIG. 1 by blocks 20 and 21, which are shown as being operatively interconnected with coordination and control 12 via paths 20*a*, 21*a* and 22. Paths linking virtual reality 20 and community 21 with each other and with participants 11 are illustrated by links 20*b*, 20*c* and 21*b*.

Important in practicing the principles of the invention are heart rate zones and exertion levels as defined above. These are illustrated by block 25 whose interaction with programming 10 and coordination and control 12 are represented by connecting links 25*a* and 25*b*. Also important in practicing the principles of the invention are the fixed and variable components of each workout regimen as represented by block 26. Interaction by the fixed and variable components with programming 10, coordination and control 12 and exertion levels/heart rate zones 25; is illustrated by links 26*a*, 26*b* and 25*a*.

Each exercise regimen includes fixed, or basic, elements and variable, or discretionary, elements as represented by block 26. The basic elements include:

1. workouts that are intended for a group and not for just any one individual, although an individual may be exercising by himself/herself and made to feel as being a part of a group by virtual reality and/or a feeling of community.
2. Warm-Up
3. Steady-State
4. Challenge
5. Cool-Down The variable, or discretionary, elements include:

1. Dialog and verbal cues
2. Music
3. Program continuity
4. Guidance and Instruction
5. Motivation
6. Entertainment
7. Monitoring of Achievement
8. Levels of Exertion
9. Heart Rate Zones
10. Participation
11. Interaction
12. Feeling of Community Thus, provision is made for a variety of workout regimens, each embodying the foregoing basic elements augmented by selected ones of the foregoing variable, or discretionary elements. In addition, it should be noted that the class length (duration of the workouts) is preferably, but not necessarily about 30 minutes. It should also be noted that workouts often differ in length of time, difficulty and amount of instruction.

Typically, in implementing the system, participants are provided an orientation. This orientation, or introduction, to the system is implemented through provision of a VO2 Maxed™ system starter kit. This kit includes an orientation workout, written instructions about the standard and variable components of workout regimens. Clients are provided with: (1) a way to chose their preferred way of listening to the classes (usually a CD player or digital audio device with headphones), and (2) a heart rate monitor. The starter kit normally is delivered in person or by mail, although it (and subsequent workouts) may also be obtained at a retail establishment, over the internet or from a VO2 Maxed$^{SM}$ system representative or agent.

Figure 2:
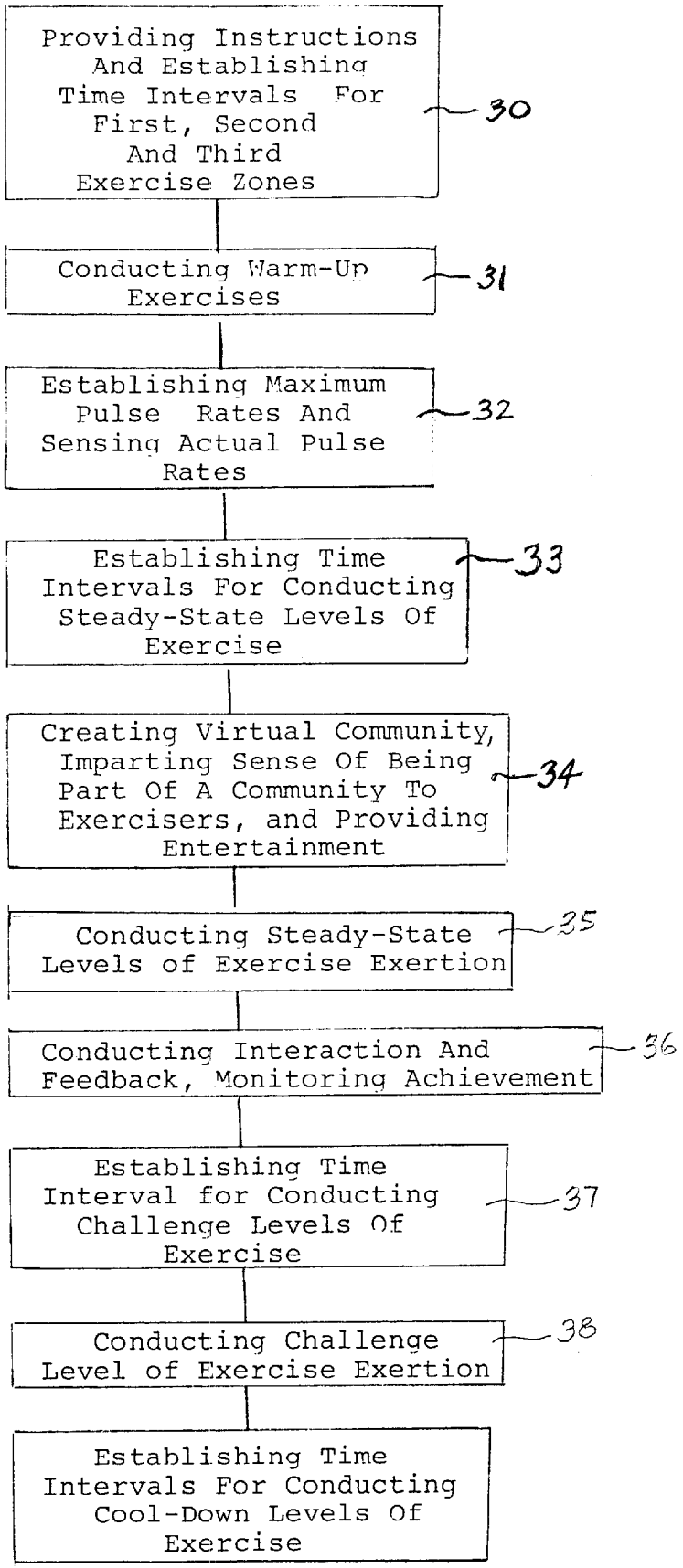
FIG. 2 is a flow diagram illustrating the interactive interrelationships and sequences of the principal steps in conducting the methods according to the invention.

Turning now to FIG. 2, a diagram illustrating an exemplary method of carrying out the principles of the invention is presented. There, it will be seen are a series of steps that include both basic and optional steps performed in conducting an exercise workout session. Thus, it will be seen that provision of general instructions together with establishment of time intervals for the first, second and third exercise zones is represented by block 30; the actual conduction of warm-up exercises (Exertion Level 1) is represented by block 31; and establishment of maximum pulse rates and sensing actual pulse rates is depicted by block 32. It should be understood that although block is shown beneath block 31, the establishment of maximum pulse rates is ordinarily performed at some earlier stage as, for example when a participant is first enrolled in the VO2 Maxed$^{SM}$ Program. Thereafter, until a participant's age changes or some unusual circumstance, the maximum heart rate for that participant should remain the same. It will also be evident that heart rate (pulse rate) monitoring normally will be performed either continuously or at specified intervals during an entire workout.

The establishment of time intervals for conducting steady-state levels of exercise are represented by block 33; the creation of virtual community, imparting a sense of being part of a community to exercisers, and the provision of entertainment are illustrated in block 34; the conduction of steady-state levels of exercise exertion (Exertion Level 2) is represented by block 35; interaction, feedback and monitoring achievement are illustrated by block 36; establishment of one or more time intervals for conducting challenge levels of exercise (Exercise Levels 3 and 4) is represented by block 37; actual conduction of exercise at the challenge levels is illustrated by block 38; and establishment of time intervals for, and the actual conduction of cool down levels of exercise is represented by block 39.

To facilitate further understanding of the invention hereof, an actual example is now set forth.

Example as Illustrated by Representative Workout

In the following description, the workout is characterized as a VO2 Maxed$^{SM}$ exercise program workout. The following is a representative example. However, it should be understood that, as will be evident from the description herein, VO2 Maxed$^{SM}$ workouts are varied. Nevertheless, every workout has standard and variable components. Content is made up of VO2 Maxed$^{SM}$ workout elements. The following is meant to illustrate the standard routines that are followed, with some examples of the main elements of workout. The standard components of a VO2 Maxed$^{SM}$ workout are:

It is a class that is intended for a group and not for just any one individual, although an individual may be exercising by himself/herself and made to feel as being a part of a group by virtual reality or a feeling of community.

There are four phases of the workout:

a. Warm-Up b. Steady-State c. Challenge d. Cool-Down

The class length is preferably about 30 minutes, although it may vary significantly from that duration.

The variable components of the workout are:

a. Dialog and verbal cues b. Music c. Program continuity d. Guidance and Instruction e. Motivation f. Entertainment g. Monitoring of Achievement h. Levels of Exertion i. Heart Rate Zones j. Participation k. Interaction l. Feeling of Community For simplicity and clarification, the principles of this invention will be illustrated in greater detail through the following description of one exemplary embodiment of an exemplary workout, according to this invention. It should be understood that this example is intended to be illustrative, not limiting, and various changes, modifications, and/or adaptations may be made without departing from the spirit and scope of this invention. For purposes of this example, the italicized, quoted text represents actual verbiage that may be heard during an exemplary workout. The standard text portions provide a description of the workout and identify specific examples of the variable components within the workout.

Standard Component:

Warm-up Stage.

Begins with specially chosen music to slowly work up to the workout. Music continues in the background during the entire phase of the workout. Music is an example of entertainment and motivation. Workouts are accompanied by music and during the workout, the artist and song are identified. Also, the music that is used during the workout is offered for sale on the web site and/or a link is provided to a partner site where the music can be purchased. Also, the member can communicate with VO2 Maxed$^{SM}$ leadership either via the Internet or regular mail to suggest specific music that will be used during workouts. This is an example of Interactivity, Participation and Community.

"Hi, and welcome back to the VO2 Maxed$^{SM}$ Guided Exercise program." Conveying the Feeling of Being Part of a Community.

"This is Sean, and I will be your guide for this workout. This is workout #60 designed for use on the elliptical and cross trainer machines. I'd like to ask you to get your equipment ready for the workout by setting your time for about 35 minutes for this is going to be about a 30 minute workout and setting your level of difficulty level to a very easy pace." The reference to time is an example of Guidance and Instruction. The fact that this is workout #60 is indicative of a Participation in a Continual Program. Also is an example of Customization because the member sets his own controls on the equipment. The fact that this workout is made for an elliptical machine, is another example of Customization.

"We're going to start off with a level 1 intensity and work toward getting our heart rates into zone 1. Example of Guidance and Instruction." The reference to zone 1 is an example of monitoring of achievement and the use of Heart Rate Zones. "If you downloaded this workout from the web site you know you're in store for a tough workout and we're going to have some tough challenges." Reference to the web site is an example of community. Reference to tough challenges is an example of motivation. "It's very important that you take your time warming up, don't go to hard too fast, you're going to need that energy. In addition we want you to take your time getting your joints and muscles warmed up, we don't want anyone getting hurt." These are examples of guidance and instruction.

"Well it feels good to be back this is our first elliptical workout since our Hawaiian trip. We're back in the studio now and although we had a great time, it is good to be back and we haven't even begun to answer all the e-mails for the workouts a, b and c. Made a lot of goodfriends and got to know the island and got to know the local customs. In fact many of you wrote in that after looking at the picture on the web site and doing the workout it seemed as though you made the trip with us and when you were working out it felt as if you were there in Hawaii with us. We had so many requests that we want to do it again." Hawaiian reference is an example of entertainment and building virtual reality and community with the new friends on the island. Reference to other workouts a, b and c is an example of community and participation. Request to do it again is an example of community, interactivity and participation.

"We are now putting together our westward tour starting in Dallas and ending up in the wine country in Napa Valley. We planned our tour to go to some of the major cities and will be stopping off at some scenic locations along the way and at some of the fitness facilities en route. If you would like to be a part of the workouts, check in out on the web site and we will have the times and places posted where and when we will be there. So if you are interested in being a part of the actual creation of a VO2 Maxed$^{SM}$ class, please make plans to join us." Trip from Dallas to Napa Valley with stops along the way is an example of entertainment, community, interactivity and participation. To be a part of the workout locally is an example of motivation.

"Again, we are taking our time getting warmed up we are at level 1 and are working to get our heart rates into zone 1. As you are warming up we are listening to some specifically chosen music and if you like this music, you can find it on our web site, and if you don't and would prefer not to hear it again on another workout, please let us know." Example of Guidance and Instruction, Levels of Exertion and Heart Rate Zones. Reference to music is entertainment. Also illustrates interactivity and participation.

"And our email comes to us from Tom in London England. Tom says, "First, let say how much I have enjoyed the program. I used to be stuck working out on the treadmill but now I find it challenging to work out on all the different equipment at my gym and that your program supports. I have noticed that my muscles get much more tired than my heart does and it is starting to get frustrating because it takes forever to get my heart into the right zones and when I do, my muscles are dying. I've been working out steadily for the last nine months, what should I do?, thanks, Tom" The email is a form of entertainment and is an example of how members participate in the program and interact with VO2 Maxed$^{SM}$ exercise program.

"Tom, thanks for a great question and I can relate to you because I am the same way. I'll start by letting you know that it is not a bad thing so don't feel bad, even though you've been working out and training hard and you thing you should be able to go without your muscles feeling bad, please don't feel bad. We are all different genetically, we all have the same number of muscles, and the same number of bones, but we all have different compositions of different type of muscle fiber. We have slow twitch and fast twitch muscles fiber and people that are endurance athletes and can go for a long time have more slow twitch muscle fiber and are a lot more efficient. Other people like power lifters or wrestlers with more fast twitch muscle fiber are more powerful and stronger out of the gate but have a harder time maintaining that and that's not because they are any less of an athlete than anyone else, it just means that you are processing energy a little differently. I can say for myself because I am more predominantly fast twitch it is harder for me to go for any length of time because I am not able to process the energy as fast as someone else can. So we have to train what we have. We can to increase or decrease the percentages that we have but we can increase the efficiency of the muscles that we do have. Through VO2 Maxed$^{SM}$ exercise programs, we can change the efficiency of our muscles." The fact that the email is being answered is another example of interactivity, community and participation. The answer given by the VO2 Maxed$^{SM}$ program guide is an example of guidance and instruction and is a form of entertainment. The issues being addressed are also an example of motivational guidance.

Standard Component: Steady-State Stage.

Utilization of different music is an example of entertainment and motivation. Also, the separation of stages of the workout is an example of motivation.

"OK, we are wrapping up our warm-up, getting into our steady state, let's take it up to a level 2 intensity, whether you want to get there by increasing your speed or the intensity is up to you. We are going to work on getting our heart rate to zone 2." This is an example of guidance and instruction, levels of exertion, heart rate zones and motivation.

"Before we hit our challenges for the workout, which we will be getting into in a bit, I want to thank Tom again for his email and tell you that your VO2 Maxed™ T-shirt is in the mail and we're sure you will wear it in London with pride. I think that is our first email from London so it seems like we are getting out to everywhere. That answer is posted out on the web site in addition to some other related information that may be interesting to you. Example of interactivity and community with emails and the VO2 Maxed™ T-shirt.

"Again, we have just bumped it up to a level 2 intensity and we are working on getting our heart rate into zone 2, that's our goal." Example of levels of exertion, heart rate zones and guidance and instruction.

"And as we do this, we are listening to another piece of motivational music." Music is an example of entertainment. Music is chosen specifically for certain parts of the workout. Also, music is an example of interactivity because some of the music in the workouts suggested by the members.

"Getting ready for our challenges for today, if you read the description on the web site, you know we're in for some tough ones. Challenge number one, we have a level 3 sprint for thirty seconds followed by thirty seconds of rest, and then we will have a level sprint for 20 seconds followed by a 40 second rest. We're going to do that two times, that's challenge number one." Preparing the member for the workout ahead is an example of motivation and guidance and instruction.

"That will bring us to our second challenge where we're going to do a level 3 sprint for 30 seconds followed by a 30 second rest. And we are going to alternate that with a one minute tension interval. We're going to do this three times. If you do this right, and challenge yourself, you're going to have a great workout. Make sure you get your mind right, using properform and technique and breathing. Breathing will help!"

This is another example of guidance and instruction, motivation along with humor in the dialog that is entertaining. "I want to remind you to keep that good up and down form, try to eliminate the side-to-side motion. Keep you hands free of your body and don't support your body weight, I encourage you to go after it with vigor, hit it hard, do what you can. If you can't do complete any of the challenges, come back do it again at another time, when you have your mind right and you can go after it again." Another example of guidance and instruction. Also illustrates a Continual Program with reference to going back and doing it again.

"But when you're done and within minutes of getting off your equipment, and cool down, you'll say to yourself how great you are going to feel all day and how much energy you're going to have. And how close you will be to attaining that total optimal healthy lifestyle. This is an example of motivation and monitoring of achievement. OK, you should be getting ready with your heart rate in zone 2 as we are getting ready to start our first challenge." Example of heart rate zones and motivation.

Standard Component: Challenge Stage.

Music is specially chosen for each stage of the workout. In general, faster music is best for the challenge phase of the workout. This is also an example of community and interactivity because some of the music used in the workouts is suggested by the members.

"Are you ready? We've got some work ahead of us. OK timer starts in 10 seconds for our first challenge, level 3 sprint for 30 seconds followed by 30 seconds rest. Are you ready? I'm ready. OK go, take it up. Level 3, we're on. Concentrate on your breathing. 10 seconds, hang on to it. 3,2,1 take it down, back down to level 1." This dialog takes place throughout the challenge phase. It is an example of guidance and instruction. It is also an example of Member Enabled Customization in two ways. First, the exercise equipment usually has control settings. The VO2 Maxed$^{SM}$ guide does not tell the member to adjust their controls to any specific setting. Instead he guides and instructs the member to use levels of exertion and heart rate zones to determine the control settings on the equipment. Further, because every member has different levels of exertion and heart rate zones, the control settings on the equipment may be different for each member.

"OK our next sprint is level 4, we go in 15 seconds, going to do it for 20. Next sprint level 4, higher than your last sprint. Get ready, 5,4,3,2,1 take it up, level 4, come on! Move your legs. Little bit longer, OK 5,4,3,2,1 take it back down, level 1." This is another example of guidance and instruction. The specific verbal cues such as 'come on' and 'move your legs' are examples of motivation. Use of Levels and Zones is an example of Member Enabled Customization.

"Forty-second rest, one down, one to go for challenge one. 20 more seconds rest. Hit your mark on this next one, same thing that we just did. Level 3 sprint for 30 seconds. Get ready, 3,2,1 go. Level 3, take it up. 75–85% lets go." Special music is chosen for this portion of the workout, which will help the member maintain 75–85%. Also, the music is played by itself for a longer period of time. This is an example of entertainment and motivation.

"15 seconds. 3,2,1 take it back down, level 1, 30-second rest then we go after our final one for this challenge." Examples of guidance and instruction. Levels of Exertion and Member Enabled Customization are illustrated here. Also, verbal cues are an example of motivation, getting the member ready for the next stage of the workout.

"We go in 15. The last one for challenge one, take a level 4. Are you ready, level 4 get set, go, take it up. Move your legs. Let's go, come on. And take it back down. Good job." Examples of guidance and instruction, Levels of Exertion, Member Enabled Customization and Motivation.

"You've got one-minute rest then we start our second challenge. Come on, we're half way through the workout, it's all a piece of cake from here." Examples of guidance and instruction and motivation. During this time, special music is played to assist in the member's recovery and is an example of entertainment.

"Get a drink. Towel off Getting ready for our second challenge, remember we have a level 3 sprint for 30, followed by 30 second rest, then we go with a one minute, level 3 tension, we're going to do that three times." The use of the term 'tension' is an example of Member Enabled Customization because there are different control settings on different equipment. The fact that this member chose to workout on the elliptical machine is a way of customizing the class workout for himself/herself.

"Get your mind right from the start and get ready. OK, we're going to start it off the same as we did last time, we have a level 3 30 second sprint. 3,2,1 go, take it up, level 3." Example of guidance and instruction, levels of exertion and member enabled customization.

"Great form, concentrate on your breathing." Verbal cues for guidance and instruction. During this part of the exercise, the specially chosen music is an example of motivation and entertainment.

"5,4,3,2,1 take it back down to level 1 rest. Get ready to increase the tension and really work your legs here. We go in ten. 3,2,1 take it up, take you tension up to level 3, let's go. Feel that resistance against your legs. You're going to feel extremely good when that minute is up. Come on, let's go. Let's go. Push through it. You're halfway there, 30 seconds to go. Don't lose speed, come on. 10 seconds. Take your tension back down to level 1 for your rest. You've got a minute, make sure you get your rest." Verbal cues are examples of motivation, guidance and instruction and levels of exertion for member enabled customization.

"You've got one-minute rest, if you're advanced go a little harder during the rest. We've got two more of what we just did, then it's all down hill. Go in 30, level 3 sprint, 30 seconds, don't hold back, give it what you've got. Go in 15. Get ready. 3,2,1 pick up your speed, 30 seconds, come on. Come on, everything is working in sync, everything moving forward. 10 seconds. 3,2,1 take it down, level 1, catch your breath." Examples of guidance and instruction, verbal cues are examples of motivation and levels of exertion used for member enabled customization.

"In 15, we're going to take our tension up in 15. Get ready, get set, take it up, level 3 one minute, come on, work your levels. Slow cadence, 75–85% tension, come on. Have no reason to hold back. Halfway, come on, you can do it. 20 seconds. 5,4,3,2,1 take it back down, level 1, 30-second break, 30-second break, we have one more, we're almost done." Examples of guidance and instruction, verbal cues are examples of motivation and levels of exertion used for member enabled customization.

"We go in 20. Come on work your levels, no holding back. We go in 10. 3,2,1 take it up, level 3 speed, take it up, this is our last one. No holding back, moving fast seconds. Take your speed down to level 1, you've got 30 seconds and then we finish up with our last resistance." Examples of guidance and instruction, verbal cues are examples of motivation and levels of exertion used for member enabled customization.

"Get ready. It's the last one we're going to do then it's cool down. 3,2,1 take it up, level 3 resistance, one minute, let's go. Don't give in to it now, it's almost over. Come on, push through it. Finish strong, let's go. Strong legs, strong heart, strong mind. Nothing getting in your way. You're going to finish this one. It's now or never." Specially chosen music helps member finish this portion of the workout and is an example of motivation and entertainment.

"Come on, paying the price now. 10 seconds. And take it back down. Level 1 resistance. Great job." Examples of guidance and instruction, verbal cues are examples of motivation and levels of exertion used for member enabled customization.

"OK, if you did that right, heart rate zones were in zone 3, you worked hard, packed it in. We're going to reward ourselves with a change in music tempo. Back to a level 1. Level 1 resistance and level 1 perceived exertion with our goal to get our heart rates back to zone 1." Examples of guidance and instruction, levels of exertion and heart rate zones used for member enabled customization. Also, reference to the music change is entertainment and motivation. The music choice provides entertainment.

Standard Component: Cool-Down Stage.

"If you were able to hit your marks on the challenges, congratulations. If not, you'll be able to do it soon, I promise. Just keep at it but make sure you get proper rest and are getting the proper nutrients." Examples of guidance and instruction, motivation and monitoring of achievement.

"These workouts were designed to ask your body to improve, get better, become more efficient, not only to lose bodyfat, but to gain energy, feel better, feed your muscles, feed your brain, increase your metabolism. If you just want regular health and keep the status quo, you can just turn on the news, get on your treadmill and just walk for an hour at a nice steady pace. If that's what you want, that's what you'll get. If you want to go after that incredible feeling, that total and optimal healthy lifestyle, where your body is just always burning fat and calories and you're constantly being fed with energy and oxygen, then this is it for you. Getting better every workout." Examples of motivation, monitoring of achievement and feeling of community.

"While you're cooling down, make sure you're breathing correctly, breath in through the nose and out through the mouth. By now, you've been asked to imagine that oxygen is going into your brain, concentrate on it going into your entire body. Before you know it, you're full of energy." Examples of guidance and instruction and verbal cues about breathing that provide member enabled customization.

"OK, we're finishing up our cool down with a slow song. Your heart rate should be at least in zone 2, getting into zone 1." Examples of guidance and instruction, also change of music provides entertainment.

"If you took this work out right, it was difficult because we hit it hard without a lot of rest. There are different kinds of workouts and this one kept you up there and kept you working." Examples of motivation and monitoring of achievement.

"In all the surveys that we have been getting back from VO2 Maxed$^{SM}$ class members and the feedback we are getting is that number one is that there is variety and difference. You are telling us that you like the guidance and the entertainment but most important is that the workouts are different. And you have a choice when you go to the web site to decide which one to work out to. The reason you are staying with it, hopefully longer than any other workout routine you have tried." Examples of community, participation, interactivity and feeling of community. Interaction with the web site and emails.

"While we continue to cool down, concentrate on your breathing, in through the nose and out through the mouth. Breath deep. If you were able to meet your challenges today, way to go. If not, you're welcome to come back and do it again and again until you get it but if you don't, that's OK too, You'll still he getting better." Examples of motivation, monitoring of achievement and program continuity.

"I'd like to finish up the workout and the cool down with some closing thoughts. As I was flying back from Hawaii, I read an article about a group of ladies who all went through a similar journey together. They all had breast cancer. They met through the Internet and began training for rowing together and they talked about their adversities. It was a really expiring story and we have gotten permission to post it to our web site with a link to their web site. I don't want to give too much away but would like to encourage you to take a look at it on our web site. It was very inspirational and as you know here at VO2 Maxed$^{SM}$ classes, 5% of our profits go toward the physically disabled. To people that don't have the ability to get exercise on a piece of equipment. We hope this serves as an incentive for you to get out there every day and exercise for yourself and for those who can't. Until the next time we can get together again, please be safe, have fun and may you live your life with the energy of your full potential, don 't take it for granted. Take care." The story is an example of motivation and entertainment. The policy of VO2 Maxed$^{SM}$ programs to give 5% back to charity is also motivation and feeling of community. Reference to another VO2 Maxed$^{SM}$ workout is an example of program continuity.

It should be remembered that this example of an exemplary workout was intended to be illustrative, not limiting, and various changes, modifications, and/or adaptations may be made without departing from the spirit and scope of this invention.

While the inventions hereof have been described in connection with certain exemplary embodiments, the exemplary embodiments are not intended to limit the scope of the inventions to the particular forms set forth; but on the contrary, the inventions hereof are intended to cover any alternatives, modifications, and equivalents that may be included within the spirit and scope of the inventions as described herein.

The terms and expressions employed herein are employed as terms of description and not of limitation; and thus there is no intent to exclude equivalents, but on the contrary it is intended to cover any and all equivalents that may be employed without departing from the spirit and scope of the inventions.

What is claimed is:

1. A guided instructional exercise system for individual exercise workouts, comprising:

an exercise device that is adjustable by a user to require varying levels of exercise exertion by said user;

timing means for establishing exercise time intervals for said user;

means for sensing a pulse rate of said user while said user is exercising;

virtual community means for imparting to said user a sense of being part of a community of exercisers; and motivational guidance means for providing instructions, varying exertion level criteria, and a time interval to said user such that said user may establish on said exercise device levels of exercise exertion customized according to said exertion level criteria suggested by said motivational guidance means, wherein said user must determine an individually appropriate level of exertion based on said exertion level criteria suggested by said motivational guidance means and the sensed pulse rate, and wherein said user must make any necessary adjustments to said exercise device, such that said exercise device supplies an appropriate level of exercise resistance to said user.

2. A guided instructional exercise system according to claim 1 wherein said exercise device is selected from a group consisting of exercise bicycle, elliptical cross trainer, stair stepper mill and treadmill.

3. A guided instructional exercise system according to claim 1 wherein said exertion level criteria include predetermined pulse rates.

4. A guided instructional exercise system according to claim 3 wherein establishment of maximum pulse rates for said users includes subtracting the age of each user from 220.

5. A guided instructional exercise system according to claim 4 wherein said varying levels of exertion include Exertion Level one, Exertion Level two; and Exertion Level three.

6. A guided instructional exercise system according to claim 5 further including Exertion Level four.

7. A guided instructional exercise system according to claim 1 wherein said exercise device is adjustable by said user to present varying levels of resistance thereby requiring varying levels of exercise exertion by said user.

8. A guided instructional exercise system according to claim 1 wherein said virtual community means for imparting to said user a sense of being part of a community of exercisers includes visual sensations imparted to said user.

9. A guided instructional exercise system according to claim 1 wherein said virtual community means for imparting to said user a sense of being part of a community of exercisers includes audible sensations imparted to said user.

10. A guided instructional exercise system according to claim 9 wherein said virtual community means for imparting to said user a sense of being part of a community of exercisers includes visual sensations imparted to said user.

11. A guided instructional exercise system according to claim 9 wherein said virtual community means for imparting to said user a sense of being part of a community of exercisers includes earphones worn by said user while undergoing exercise.

12. A guided instructional exercise system according to claim 1 wherein each of said individual exercise workouts includes a warm-up phase, a steady-state phase, a challenge phase and a cool-down phase.

13. A guided instructional exercise system according to claim 1 further including entertainment to entertain said user while said user is exercising.

14. A guided instructional exercise system according to claim 13 in which said entertainment for selected ones of said workouts differs from workout to workout.

15. A guided instructional exercise system according to claim 13 wherein said entertainment includes visual portrayal of a scenic location.

16. A guided instructional exercise system according to claim 1 further including music for listening by said user while said user is exercising.

17. A guided instructional exercise system according to claim 1 further including means for monitoring achievement by said user while said user is exercising.

18. A guided instructional exercise system according to claim 1 further including interaction means for providing interaction between said user and said system while said user is exercising.

19. A guided instructional exercise system according to claim 1 wherein each of said individual exercise workouts includes multiple elements selected from a group of elements consisting of dialog and verbal cues, music, program continuity, guidance and instruction, motivation, entertainment, monitoring of achievement, levels of exertion, heart rate zones, participation, interaction, and feeling of community.

20. A guided instructional exercise system according to claim 18 wherein each of said individual exercise workouts includes a warm-up phase, a steady-state phase, a challenge phase and a cool-down phase.

21. A method of guiding exercise participants comprising steps of:

providing instructions, exertion level criteria, and a time interval to said exercise participants for conducting at least one warm-up exercise;

allowing each of said exercise participants to participate in said warm-up exercise at a level of exercise exertion individually determined by each exercise participant, wherein each exercise participant individually determines a level of exercise exertion based on said provided exertion level criteria;

allowing each of said exercise participants to individually sense a pulse rate while participating in said warm-up exercise;

allowing each of said exercise participants to continue said warm-up exercise at a level of exercise exertion individually determined by each exercise participant, wherein each exercise participant individually determines a level of exercise exertion based on said provided exertion level criteria and the sensed pulse rate;

providing instructions, exertion level criteria, and a time interval for conducting at least one steady-state level of exercise;

allowing each of said exercise participants to participate in said steady-state level of exercise at a level of exercise exertion individually determined by each exercise participant, wherein each exercise participant individually determines a level of exercise exertion based on said provided exertion level criteria;

allowing each of said exercise participants to individually sense a pulse rate while participating in said steady-state level of exercise;

allowing each of said exercise participants to continue said steady-state level of exercise at a level of exercise exertion individually determined by each exercise participant, wherein each exercise participant individually determines a level of exercise exertion based on said provided exertion level criteria and the sensed pulse rate providing instructions, exertion level criteria, and a time interval for conducting at least one challenge level of exercise;

allowing each of said exercise participants to participate in said challenge level of exercise at a level of exercise exertion individually determined by each exercise participant, wherein each exercise participant individually determines a level of exercise exertion based on said provided exertion level criteria;

allowing each of said exercise participants to individually sense a pulse rate while participating in said challenge level of exercise;

allowing each of said exercise participants to continue said challenge level of exercise at a level of exercise exertion individually determined by each exercise participant, wherein each exercise participant individually determines a level of exercise exertion based on said provided exertion level criteria and the sensed pulse rate providing instructions, exertion level criteria, and a time interval for conducting at least one cool-down level of exercise;

allowing each of said exercise participants to participate in said cool-down level of exercise at a level of exercise exertion individually determined by each exercise participant, wherein each exercise participant individually determines a level of exercise exertion based on said provided exertion level criteria;

allowing each of said exercise participants to individually sense a pulse rate while participating in said cool-down level of exercise;

allowing each of said exercise participants to continue said cool-down level of exercise at a level of exercise exertion individually determined by each exercise participant, wherein each exercise participant individually determines a level of exercise exertion based on said provided exertion level criteria and the sensed pulse rate.

22. The method of claim 21 wherein said steady-state level of exercise is at a higher level of exertion than said warm-up exercises.

23. The method of claim 22 wherein said challenge level of exercise is at higher level of exertion than said steady-state level of exercise.

24. The method of claim 23 wherein said cool-down level of exercise is at a level of exertion lower than said steady-state and said challenge level of exercise.

25. The method of claim 21 further including providing entertainment for said participants while said participants are exercising.

26. The method of claim 25 wherein said step of providing entertainment for said participants includes providing music.

27. The method of claim 25 wherein said step of providing entertainment for said participants includes a visual portrayal of a scenic location.

28. The method of claim 21 further including monitoring of achievement by said participants while said participants are exercising.

29. The method of claim 21 further including a step of conducting interaction between said participants and said system.

30. The method of claim 29 wherein said interaction includes feedback from said participants.

31. The method of claim 21 further including a step of establishing a maximum pulse rates for each of said exercise participants by subtracting the age of each of said exercise participants from 220.

32. The method of claim 31 further including identifying exercise zones as a first zone in which pulse rates of said participants approximate 60 to 70 percent of said maximum pulse rates; a second zone in which pulse rates of said participants approximate 70 to 80 percent of said maximum pulse rates; and a third zone in which pulse rates of said participants approximate 80 to 90 percent of said maximum pulse rates.

33. A guided instructional exercise system according to claim 1 wherein said exercise device requires varying levels of exertion by said user through at least one of faster speed and increased resistance.

34. The method of claim 21 further including providing a virtual community for imparting to said exercise participants a sense of being part of a community of exercisers.

35. A method of guiding at least one exercise participant comprising:

providing instructions, exertion level criteria, and a time interval to said exercise participant for conducting at least one warm-up exercise;

allowing said exercise participant to participate in said warm-up exercise at a level of exercise exertion determined by said exercise participant, wherein said exercise participant determines a level of exercise exertion based on said provided exertion level criteria;

allowing said exercise participant to sense a pulse rate while participating in said warm-up exercise;

allowing said exercise participant to continue said warm-up exercise at a level of exercise exertion determined by said exercise participant, wherein said exercise participant determines a level of exercise exertion based on said provided exertion level criteria and the sensed pulse rate;

providing instructions, exertion level criteria, and a time interval for conducting at least one steady-state level of exercise;

allowing said exercise participant to participate in said steady-state level of exercise at a level of exercise exertion determined by said exercise participant, wherein said exercise participant determines a level of exercise exertion based on said provided exertion level criteria;

allowing said exercise participant to sense a pulse rate while participating in said steady-state level of exercise;

allowing said exercise participant to continue said steady-state level of exercise at a level of exercise exertion determined by said exercise participant, wherein said exercise participant determines a level of exercise exertion based on said provided exertion level criteria and the sensed pulse rate providing instructions, exertion level criteria, and a time interval for conducting at least one challenge level of exercise;

allowing said exercise participant to participate in said challenge level of exercise at a level of exercise exertion determined by said exercise participant, wherein said exercise participant determines a level of exercise exertion based on said provided exertion level criteria;

allowing said exercise participant to sense a pulse rate while participating in said challenge level of exercise;

allowing said exercise participant to continue said challenge level of exercise at a level of exercise exertion determined by said exercise participant, wherein said exercise participant determines a level of exercise exertion based on said provided exertion level criteria and the sensed pulse rate providing instructions, exertion level criteria, and a time interval for conducting at least one cool-down level of exercise;

allowing said exercise participant to participate in said cool-down level of exercise at a level of exercise exertion determined by said exercise participant, wherein said exercise participant determines a level of exercise exertion based on said provided exertion level criteria;

allowing said exercise participant to sense a pulse rate while participating in said cool-down level of exercise;

allowing said exercise participant to continue said cool-down level of exercise at a level of exercise exertion determined by said exercise participant, wherein said exercise participant determines a level of exercise exertion based on said provided exertion level criteria and the sensed pulse rate.

36. The method of claim 35 wherein said instructions are delayed instructions.

37. The method of claim 35 wherein said instructions are given in real time.

38. A method of guiding an exercise participant comprising:

providing instructions, exertion level criteria, and a time interval to said exercise participant for conducting at least one warm-up exercise;

allowing said exercise participant to participate in said warm-up exercise at a level of exercise exertion determined by said exercise participant, wherein said exercise participant determines a level of exercise exertion based on said provided exertion level criteria;

providing instructions, exertion level criteria, and a time interval for conducting at least one steady-state level of exercise;

allowing said exercise participant to participate in said steady-state level of exercise at a level of exercise exertion determined by said exercise participant, wherein said exercise participant determines a level of exercise exertion based on said provided exertion level criteria;

providing instructions, exertion level criteria, and a time interval for conducting at least one challenge level of exercise;

allowing said exercise participant to participate in said challenge level of exercise at a level of exercise exertion determined by said exercise participant, wherein said exercise participant determines a level of exercise exertion based on said provided exertion level criteria;

providing instructions, exertion level criteria, and a time interval for conducting at least one cool-down level of exercise;

allowing said exercise participant to participate in said cool-down level of exercise at a level of exercise exertion determined by said exercise participant, wherein said exercise participant determines a level of exercise exertion based on said provided exertion level criteria.

* * * * *